US005596168A

United States Patent [19]

Menke et al.

[11] Patent Number: 5,596,168

[45] Date of Patent: Jan. 21, 1997

[54] SOLID PROPELLANT BASED ON PHASE-STABILIZED AMMONIUM NITRATE

[75] Inventors: Klaus Menke, Bruchsal; Jutta Bohnlein-Mauss, Speyer; Helmut Schmid; Klaus M. Bucerius, both of Karlsruhe; Walther Engel, Wöschbach, all of Germany

[73] Assignee: Fraunhofer-Gesellschaft zur Forderung der angewandten Forschung e.V., Munich, Germany

[21] Appl. No.: 536,140

[22] Filed: Sep. 29, 1995

[30] Foreign Application Priority Data

Oct. 5, 1994 [DE] Germany ..... 44 35 524.6

[51] Int. Cl.[6] ..... C06B 45/10

[52] U.S. Cl. ..... 149/19.4; 149/19.1; 149/19.6

[58] Field of Search ..... 149/19.1, 19.4, 149/19.6

[56] References Cited

U.S. PATENT DOCUMENTS

| | | | |
|---|---|---|---|
| 3,340,111 | 9/1967 | Stammler | 149/19.4 |
| 3,609,115 | 9/1971 | Sammonds et al. | 149/19.1 |
| 3,629,019 | 12/1971 | Lawrence | 149/19.5 |
| 3,822,154 | 7/1974 | Lawrence et al. | 149/19.4 |
| 3,924,405 | 12/1975 | Cohen et al. | 149/19.1 |
| 4,158,583 | 6/1979 | Frosch | 149/19.4 |
| 4,166,045 | 8/1979 | Rudy et al. | 149/19.4 |
| 4,318,270 | 3/1982 | Orlick et al. | 149/19.1 |
| 4,411,717 | 10/1983 | Anderson | 149/19.4 |
| 5,074,938 | 12/1991 | Chi | 149/19.4 |
| 5,076,868 | 12/1991 | Doll et al. | 149/19.4 |
| 5,292,387 | 3/1994 | Highsmith et al. | 149/19.91 |

*Primary Examiner*—Edward A. Miller
*Attorney, Agent, or Firm*—Antonelli, Terry, Stout & Kraus

[57] ABSTRACT

A solid propellant for rocket propulsion systems or gas generators comprises 35 to 80 wt. % ammonium nitrate (AN) in pure or nickel oxide, potassium or cesium nitrate phase-stabilized form (PSAN) with an average particle size of 5 to 200 μm, 15 to 50 wt. % of a binder system of a binder polymer and an energy-rich plasticizer, as well as 0.2 to 5 wt. % of a burning moderator of vanadium/molybdenum oxide in the form of an oxide mixture or mixed oxide.

25 Claims, 5 Drawing Sheets

SOLID PROPELLANT BASED ON PHASE-STABILIZED AMMONIUM NITRATE

FIELD OF THE INVENTION

The invention relates to a solid propellant for rocket propulsion systems or gas generators containing as the oxidizer ammonium nitrate (AN) in pure or phase-stabilized form (PSAN).

BACKGROUND OF THE INVENTION

Solid propellants of the aforementioned type generally have a low burning speed and a high pressure exponent. The burning speed or rate can be increased by adding solid, high-energy substances such as octogen (HMX) or hexogen (RDX), or metals having a high heat of combustion, such as aluminium or boron. Combinations with energy-rich binders serve the same function. These include isocyanate-bound glycidylazido polymers (GAP), nitrate ester-containing polymers, such as polyglycidyl nitrate and polynitratomethylethyloxetan or nitro- amino-substituted polymers. Even though this leads to a rise in the burning rate, the pressure exponent and the temperature coefficient are only slightly or not reduced.

Additions of ammonium perchlorate, which lead to a rise in the burning speed, admittedly reduce with a higher dosage the pressure exponent, but lead to the formation of hydrochloric acid in the exhaust and therefore to higher smoke formation with high atmospheric humidity.

In the case of double base and composite double base solid propellants the burning behaviour can be favourably influenced by adding lead and copper salts or oxides in conjunction with carbon black, but said additives can only be used to a limited extent in the case of ammonium nitrate-containing propellants. Said salts and oxides mainly act in the sense of increasing the burning rate, but do not allow an adequate drop of the pressure exponent.

The problem of the invention is to improve the burning behaviour of solid propellants based on pure and phase-stabilized ammonium nitrate.

SUMMARY OF THE INVENTION

According to the invention such a solid propellant comprises 35 to 80 wt. % ammonium nitrate (AN) in pure or nickel oxide, potassium or cesium nitrate phase-stabilized form (PSAN) with an average particle size of 5 to 200 μm, 15 to 50 wt. % of a binder system formed from a binder polymer and an energy-rich plasticizer, as well as 0.2 to 5.0 wt. % of a burning moderator of vanadium/ molybdenum oxide as an oxide mixture or mixed oxide.

Solid propellants having this formulation have a very favourable burning behaviour. As a function of the composition burning speeds above 8 mm/s are obtained at normal temperature and a combustion chamber pressure of 10 MPa. In the range 4 to 25 MPa, optionally 7 to 25 MPa, the pressure exponent reaches values of n ¾ 0.6 and in the most favourable case n ¾ 0.5. This burning behaviour makes the solid propellants with the composition according to the invention particularly suitable for use in flying objects of the tactical or strategic rocket defence.

Figure 1:
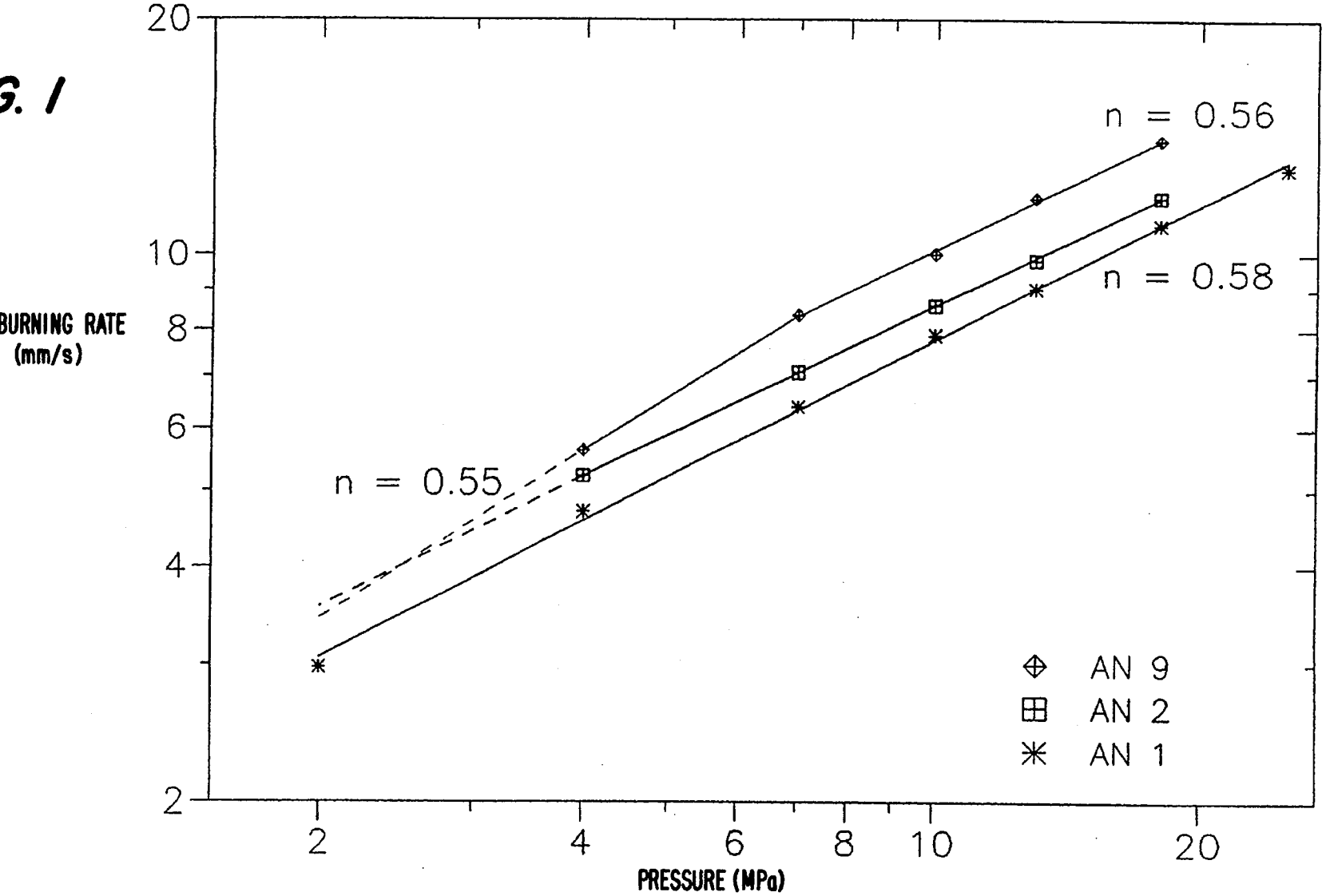
FIGS. 1–5 are graphs showing burning rate exponent vs. pressure curves of propellants according to the invention.

The solid propellants according to the invention are initially characterized in that they contain as the oxidizer pure AN or nickel oxide, potassium or cesium nitrate-transformed, phase-stabilized ammonium nitrate, the nickel oxides preferably representing 1 to 7 wt. % and the potassium or cesium nitrate 3 to 15 wt. %. They stabilize the crystal phases of AN and suppress higher volume changes of the particles in the temperature range −40 to +70° C. The incorporation into the crystal matrix of the AN takes place via a chemical reaction of the additives with the melt of the pure ammonium nitrate, accompanied by dehydration. The particle shape most favourable for producing the propellant can be obtained by spraying the melt and rapid cooling in cold, cyclon-like guided air flow. For low-smoke propellants AN is preferably used in the pure form with a water content below 0.2 wt. % or alternatively NiO-stabilized PSAN is used. In the case of potassium or cesium nitrate-stabilized PSAN somewhat higher smoke percentages occur.

The burning behaviour is decisively influenced by the particle size of AN or PSAN. Preferably use is made of a fine crystalline form with an average particle size of 5 to 200 μm with a proportion of 35 to 80 wt. % in the propellant. Particularly favourable burning values are obtained if the AN or PSAN fraction is preponderantly present with the smaller particle size of 10 to 80 μm and less in the average particle size of 100 to 160 μm.

The solid propellant according to the invention can also contain energy-rich substances, particularly nitramines, such as hexogen (RDX) or octogen (HMX) with an average particle size of 2 to 200 μm in a proportion of 1 to 4 wt. %.

The propellant can also contain metals, such as aluminium, magnesium or boron in a proportion of 0.5 to 20 wt. % and a particle size of 0.1 to 50 μm is then recommended.

To give the propellant an adequate chemical stability, it is advantageous to add to it stabilizers acting as nitrogen oxide and acid traps. It is possible to use in preferred manner diphenyl amine, 2-nitrodiphenyl amine and N-methyl nitroaniline, which are in each case used alone or combined with one another in concentrations of 0.4 to 2 wt. %. They can in particular be combined in the case of nitrate-containing propellants with small quantities of around 0.5 wt. % of magnesium oxide acting in the same way.

The burning moderators of vanadium/molybdenum oxide as an oxide mixture or mixed oxide used in a proportion of 0.2 to 5.0 wt. % according to the invention are advantageously added with carbon black or graphite in a proportion of 5 to 20 wt. % to the burning moderator fraction.

A further essential constituent in concentrations of 15 to 50 wt. % is a binder system consisting of a binder polymer and an energy-rich plasticizer. The binder polymer can be inert and is preferably in the form of isocyanate-hardening, difunctional or trifunctional, hydroxy-substituted polyester or polyether prepolymers. Instead of these it is also possible to use energy-rich polymers, preferably isocyanate-hardening, difunctional or trifunctional, hydroxy-substituted glycidylazido polymers.

The energy-rich plasticizers are preferably chosen from the group of chemically stable nitrate esters, nitro, nitroamino or azido plasticizers.

The nitrate esters used are in particular trimethylol ethane trinitrate, (TMETN), butane triol trinitrate (BTTN) or diethylene glycol dinitrate (DEGDN).

An example for a nitro plasticizer is a 1:1 mixture of bis dinitropropyl formal/acetal (BDNPF/A). An example of a nitroamino plasticizer is a 1:1 mixture of N-ethyl and N-methyl nitratoethyl nitroamine (EtNENA, MeNENA) or N-n-butyl-N-nitratoethyl nitroamine (BuNENA) or N,N'-dinitratoethyl nitroamine (DINA). As an azido plasticizer can in particular be used short-chain, bis azido-terminated GAP oligomers (GAP-A) or 1,5-diazido-3-nitroaminopentane (DANPE).

As a function of the content, compatibility and energy of the binder components the polymer/plasticizer ratio is 1:3 to 20:1 wt. %. Obviously the binder polymers can also be used in pure form.

To the pure or phase-stabilized ammonium nitrate are preferably added 0.1 to 1 wt. % of anticaking agent, e.g. ultrafine (particle size approx. 0.02 μm) silica gel, sodium lauryl sulphonate, tricalcium phosphate or other surfactants.

According to the invention the vanadium/molybdenum oxide burning moderators can be ideally combined with nickel and copper salts, oxides or complexes, which leads to a further rise in the burning rate.

The burning moderators preferably comprise mixed oxides, in which molybdenum is present in oxidation stage +VI and vanadium in oxidation stages +IV and +V. Exemplified mixed oxide compositions are $V_6Mo_4O_{25}$ and $V_6Mo_{15}O_{25}O_{60}$. The mixed oxides can also contain chromium (III) and titanium (IV) oxides as an inactive carrier material, which may also participate in the reaction.

In preferred manner the burning moderators have a particle size of 1 to 60 μm, preferably 1 to 10 μm and a high inner surface of 5 to 100 $m^2/g$, preferably 20 to 60 $m^2/g$.

For an average particle size below 10 μm and a constant, high inner surface, compared with a coarser particle size, the burning rate in the lower pressure range can rise considerably and the pressure exponent drop further.

The solid propellants according to the invention are advantageously further developed in that high-melting metal carbides or nitrides, preferably silicon and zirconium carbide are added in a concentration range of 0.1 to 1 wt. %. This in particular suppresses an unstable, oscillating burning behaviour when used in rocket engines. This is particularly significant for low-smoke buring propellants without metal addition.

Solid propellants of the described type, particularly with oxidizers in the form of pure AN or Ni-PSAN are suitable as a result of their energy content, low-smoke, hydrochloric acid-free burning and comparatively low mechanical and detonative sensitivity for use in rocket engines, whereas lower energy formulations with a high binder percentage are suitable for use as gas generator charges.

EXAMPLES

Table 1 in its upper part shows nine different formulations with pure ammonium nitrate and a PSAN phase-stabilized with 3% nickel oxide. In the lower part of the table are shown for the individual formulations the burning rate or speed r (mm/s) at 20° C. and at three different combustion chamber pressures and below it the pressure exponent n for different pressure ranges in brackets.

Apart from the dependence of the nature of the added burning moderator, it is also possible to see a dependence on the coarse/fine proportion of the ammonium nitrate used, as well as the azido polymer content with respect to the plasticizer portion. When AN with the average particle size of 160 μm is preponderantly present with V/MO oxide burning moderators at AN1 only just reach 8 mm/s at 10 MPa combustion chamber pressure. Without or with conventional burning moderators based on lead salts and carbon black this figure is only 6.6 mm/s for the same formulation. However, at AN2 with preponderantly fine ammonium nitrate there is a marked rise in the burning speed with a further pressure exponent drop.

As a result of the high plasticizer proportion, AN3 to AN8 have high specific pulses at 234s at AN6 and AN8, as well as 237s at AN3, AN4 and AN5 with an expansion ratio of 70:1. Particularly advantageous in this case is the synergistic action of copper compounds and V/Mo oxide burning moderators.

Most favourable is the combination of the burning rate rise, reduction of the pressure exponent and acceptable stability characteristics in the case of copper phthalocyanate.

The burning behaviour for formulation AN9 shows that also nickel diamino-dinitrate as the phase stabilizer in AN exercises a favourable action on the burning behaviour. The same was observed with formulation AN8 on adding nickel phthalocyanate. RDX addition also leads to a rise in the burning rate, but does not positively influence the pressure exponent.

Table 2 shows with examples AN10, AN11 and AN12 AN/GAP propellant formulations containing the burning moderator with different particle size and distribution, but with an otherwise identical composition. In the lower part of the table it is possible to see the burning rate rise accompanied by a pressure exponent drop obtained with a smaller particle size. AN13 shows the burning behaviour in the case of a formulation with azido plasticizer and AN14 a formulation with the addition of zirconium carbide, with the aid of which burning oscillations are suppressed when using the propellant in rocket engines.

Figure 4:
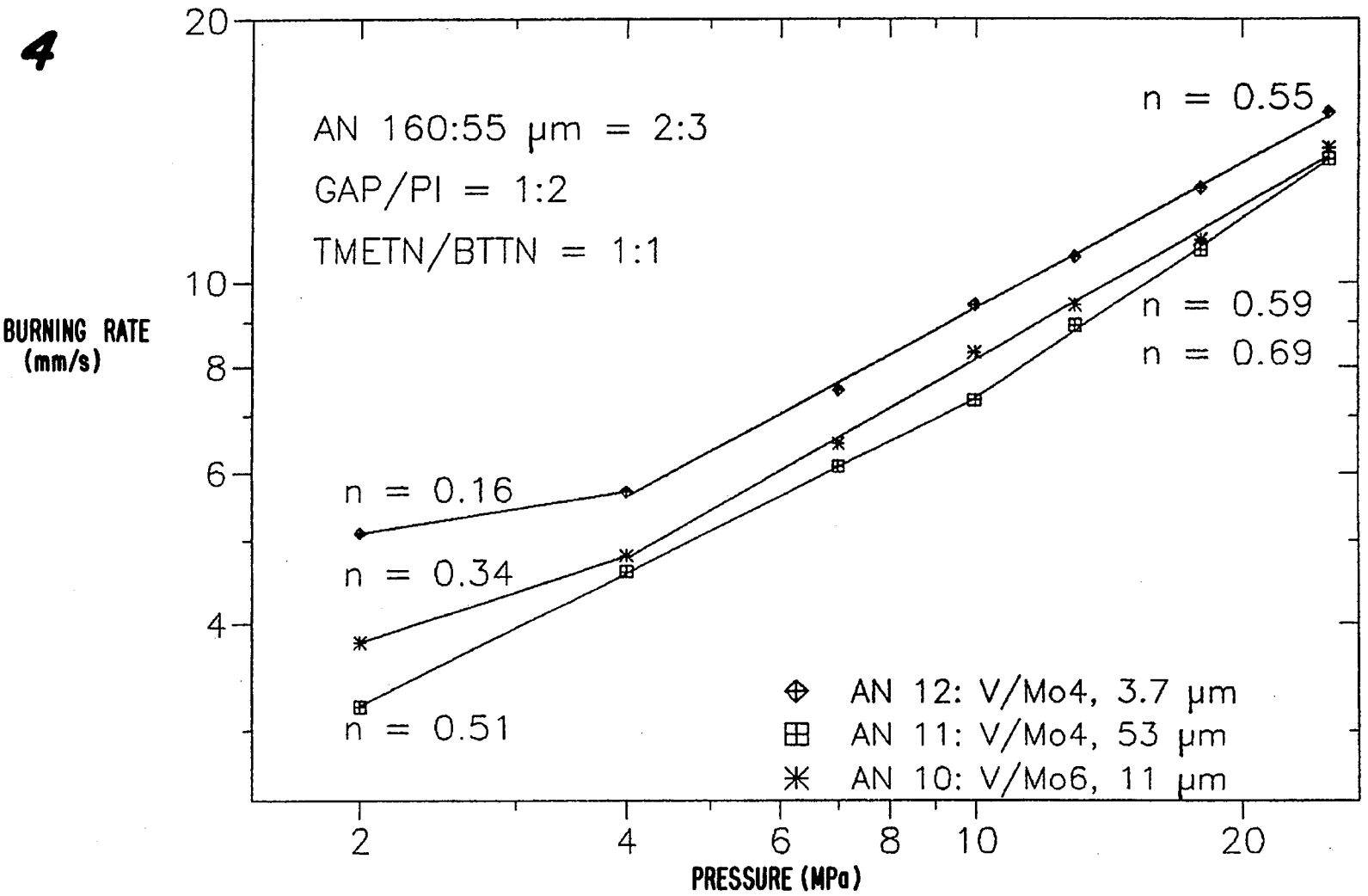
Figure 5:
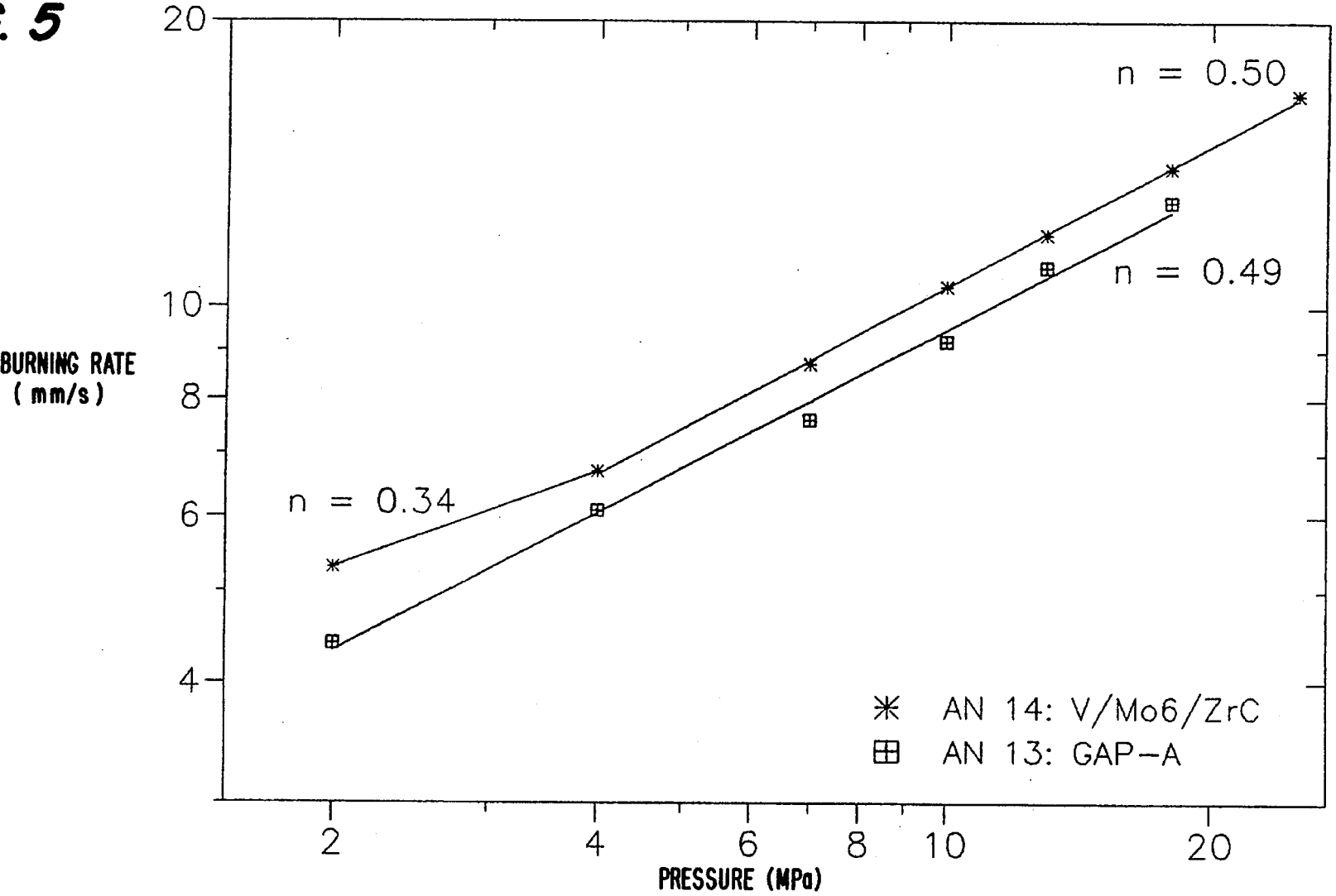

In the diagrams or graphs are shown the burning behaviour as a function of 1 g r [mm/s]=f(1 g p) [MPa]=n 1 g p +A, in which A =constant (Veilles law: $r=A\times p^n$) and namely in FIG. 1 for formulations AN1, AN2 and AN9, in FIG. 2 for AN3, AN4 and AN5, in FIG. 3 for AN7, AN8 and AN9 and in FIGS. 4 and 5 for formulations AN10, AN11, AN12, as well as AN13 and AN14.

Figure 2:
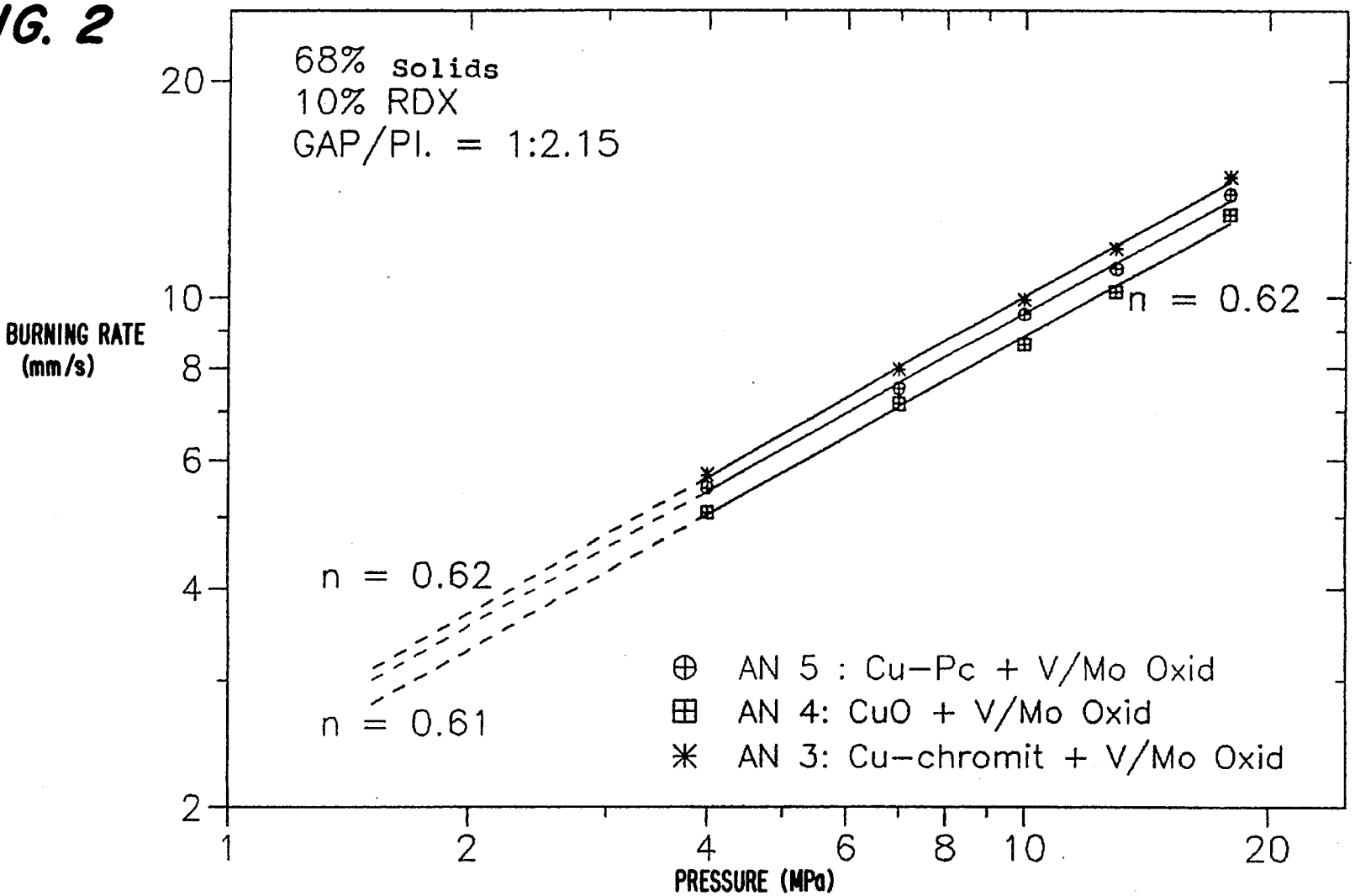
Figure 3:
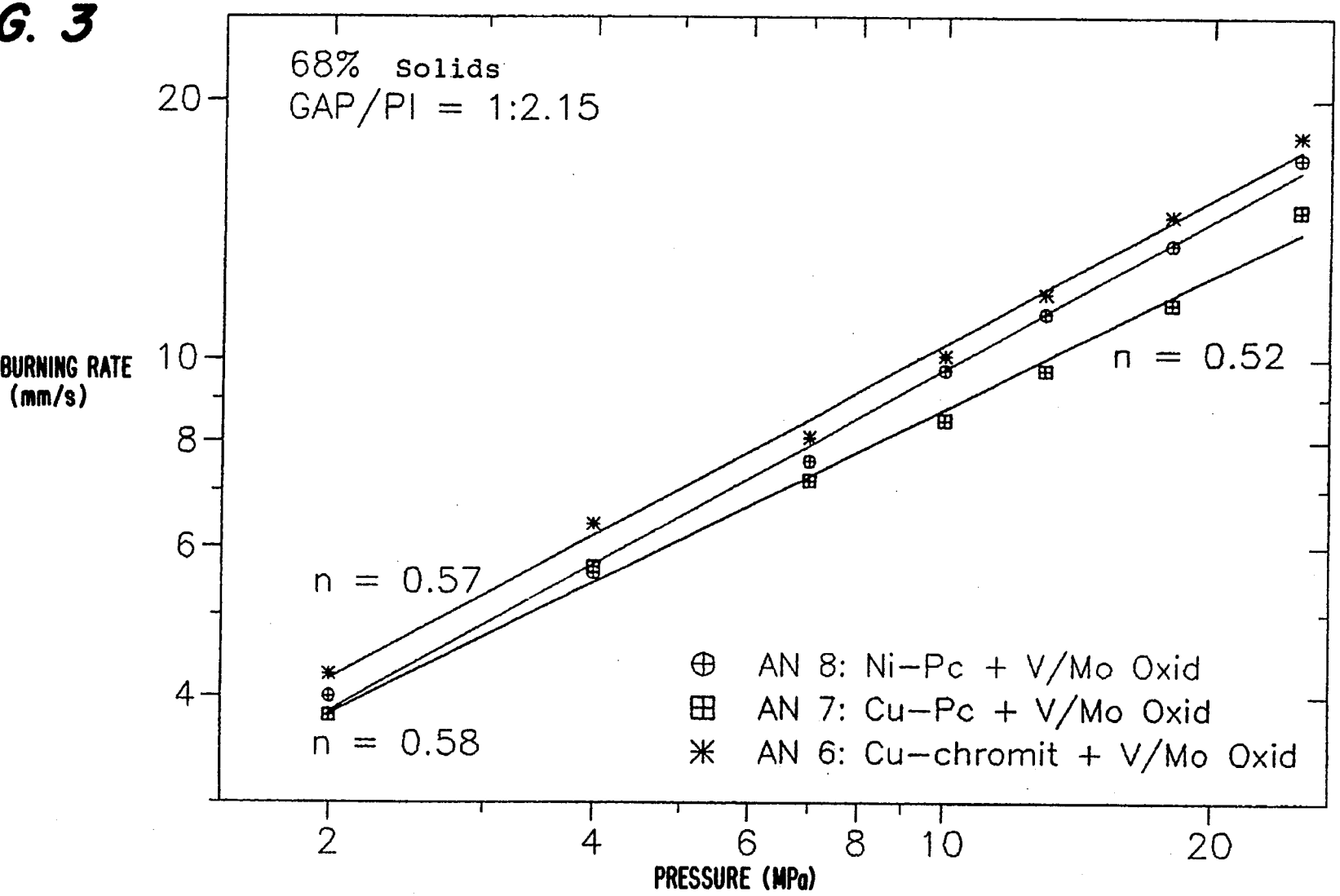

The comparison of FIGS. 1 and 2 shows that for the same RDX content of 10% the effect of the burning moderator is less pronounced at a high plasticizer proportion than with a high GAP proportion (P1=plasticizer). FIG. 3 shows an effective burning regulation in the case of a high nitrate ester proportion in the propellant without RDX addition. The synergistic action of Cu and Ni complexes with V/Mo oxide burning moderators is responsible for this.

TABLE 1

| | PROPELLANT FORMULATIONS AND BURNING CHARACTERISTICS | | | | | | | | |
|---|---|---|---|---|---|---|---|---|---|
| | AN1 | AN2 | AN3 | AN4 | AN5 | AN6 | AN7 | AN8 | AN9 |
| AN 160 μm | 42 | 22 | 22 | 22 | 22 | 26 | 26 | 26 | — |
| AN 55 μm | 18 | 33 | 33 | 33 | 33 | 39 | 39 | 39 | — |

TABLE 1-continued

| PROPELLANT FORMULATIONS AND BURNING CHARACTERISTICS | AN1 | AN2 | AN3 | AN4 | AN5 | AN6 | AN7 | AN8 | AN9 |
|---|---|---|---|---|---|---|---|---|---|
| PSAN 3% NiO 160 μm | — | — | — | — | — | — | — | — | 22 |
| PSAN 3% NiO 55 μm | — | — | — | — | — | — | — | — | 33 |
| RDX 5 μm | 10 | 10 | 10 | 10 | 10 | — | — | — | 10 |
| GAP/N100 | 18 | 16 | 10 | 10 | 10 | 10 | 10 | 10 | 16 |
| TMETN | 8.5 | 15.5 | 7.5 | 7.5 | 7.5 | 21.5 | 21.5 | 21.5 | 15.5 |
| BTTN | — | — | 14 | 14 | 14 | — | — | — | — |
| DPA | 0.5 | 0.5 | 0.5 | 0.5 | 0.5 | 0.5 | 0.5 | 0.5 | 0.5 |
| Cu-chromite | — | — | 1.0 | — | — | 1.3 | — | — | — |
| Cu-oxide | — | — | — | 1.0 | — | — | — | — | — |
| Cu-phthalocyanate | — | — | — | — | 1.0 | — | 1.3 | — | — |
| Ni-phthalocyanate | — | — | — | — | — | — | — | 1.3 | — |
| V/Mo-oxide | 2.5 | 2.5 | 1.5 | 1.5 | 1.5 | 1.3 | 1.3 | 1.3 | 2.5 |
| Carbon black | 0.5 | 0.5 | 0.5 | 0.5 | 0.5 | 0.4 | 0.4 | 0.4 | 0.5 |
| Burning rate at 20° C. (mm/s): | | | | | | | | | |
| $r_{2MPa}$ | 3.0 | 3.5 | 3.8 | 3.3 | 3.6 | 4.3 | 3.8 | 4.0 | 3.4 |
| $r_{7MPa}$ | 6.4 | 7.1 | 8.1 | 7.2 | 7.6 | 8.1 | 7.2 | 7.6 | 8.4 |
| $r_{10MPa}$ | 7.9 | 8.6 | 10.0 | 8.6 | 9.5 | 10.1 | 8.5 | 9.7 | 10.0 |
| Pressure exponent n (range mPa) | 0.58 (2–25) | 0.55 (4–18) | 0.60 (4–18) | 0.60 (4–18) | 0.60 (4–18) | 0.57 (2–25) | 0.52 (2–25) | 0.58 (2–25) | 0.56 (7–18) 0.71 (2–7) |

TABLE 2

| PROPELLANT FORMULATIONS AND BURNING CHARACTERISTICS | AN10 | AN11 | AN12 | AN13 | AN14 |
|---|---|---|---|---|---|
| AN 160 μm | 25.6 | 25.6 | 25.6 | 25.6 | 18 |
| AN 55 μm | 38.4 | 38.4 | 38.4 | 38.4 | 42 |
| RDX 5 μm | — | — | — | — | 5 |
| GAP/N 100 | 11 | 11 | 11 | 11 | 15 |
| TMETN | 11 | 11 | 11 | 17.6 | 8 |
| BTTN | 11 | 11 | 11 | — | 8 |
| GAP-A | — | — | — | 4.4 | — |
| DPA | 0.6 | 0.6 | 0.6 | 0.6 | 0.5 |
| V/Mo-oxide 53 μm | — | 2.0 | — | — | — |
| V/Mo-oxide 11 μm | 2.0 | — | — | 2.0 | — |
| V/Mo-oxide 3.7 μm | — | — | 2.0 | — | 2.4 |
| Carbon black | 0.4 | 0.4 | 0.4 | 0.4 | 0.6 |
| Zirconium carbide | — | — | — | — | 0.5 |
| Burning rate at 20° C. (mm/s) | | | | | |
| $r_2$MPa | 3.8 | 3.2 | 5.1 | 4.4 | 5.3 |
| $r_7$MPa | 6.5 | 6.1 | 7.5 | 7.6 | 8.7 |
| $r_{10}$MPa | 8.3 | 7.3 | 9.4 | 9.2 | 10.5 |
| Pressure exponent n (range MPa) | 0.59 (4–25) | 0.51 (2–10) 0.69 (10–25) | 0.55 (4–25) | 0.49 (2–18) | 0.50 (4–25) |

We claim:

1. Solid propellant for rocket propulsion systems or gas generators, comprising 35 to 80 wt. % ammonium nitrate (AN) in pure or nickel oxide, potassium or cesium nitrate phase-stabilized form (PSAN) with an average particle size of 5 to 200 μm, 15 to 50 wt. % of a binder system of a binder polymer and an energy-rich plasticizer, as well as 0.2 to 5 wt. % of a burning moderator of vanadium oxide/molybdenum oxide as an oxide mixture or mixed oxide.

2. Solid propellant according to claim 1 with a further proportion of 1 to 40 wt. % of energy-rich nitramines chosen from among hexogen or octogen with an average particle size of 2 to 200 μm.

3. Solid propellant according to claim 1 with a further proportion of 0.5 to 20 wt. % metals, chosen from among aluminium, magnesium and boron and having a particle size of 0.1 to 50 μm.

4. Solid propellant according to claim 1 with a further proportion of 0.4 to 2 wt. % of a stabilizer, acting as a nitrogen oxide and acid trap, of diphenyl amine, 2-nitrodiphenyl amine or N-methyl nitroaniline or a combination thereof.

5. Solid propellant according to claim 1 with an addition of carbon black or graphite with 5 to 50 wt. % of the burning moderator fraction.

6. Solid propellant according to claim 1, wherein the binder polymer is an isocyanate-hardening, bifunctional or trifunctional, hydroxy-substituted polyester or polyether prepolymer.

7. Solid propellant according to claim 1, wherein the binder polymer is an energy-rich polymer.

8. Solid propellant according to claim 7, wherein the energy-rich polymer is an isocyanate-hardening, bifunctional or trifunctional, hydroxy-substituted glycidylazido polymer (GAP).

9. Solid propellant according to claim 1, wherein the energy-rich plasticizer is chosen from the group of chemically stable nitrate esters, nitro, nitroamino or azido plasticizers.

10. Solid propellant according to claim 9, wherein the nitrate ester is a trimethylol ethane trinitrate (TMETN), butane triol trinitrate (BTTN) or diethylene glycol dinitrate (DEGDN).

11. Solid propellant according to claim 9, wherein the nitro plasticizer is a 1:1 mixture of bis dinitropropyl formal/bis dinitropropyl acetal (BDNPF/BDNPA).

12. Solid propellant according to claim 9, wherein the nitroamino plasticizer is a 1:1 mixture of ethyl and N-methyl nitratoethyl nitroamine (EtNENA and MeNENA) or N-n-butyl-N-nitratoethyl nitramine (BuNENA) or N,N'-dinitratoethyl nitramine (DINA).

13. Solid propellant according to claim 9, wherein the azido plasticizer comprises short-chain GAP oligomers (GAP-A) with terminal bis azido groups or 1,5 diazido-3-nitroaminopentane (DANPE).

14. Solid propellant according to claim 1, characterized in that the binder polymers and plasticisers are present as a function of the nature, compatibility and energy content in the binder system in a ratio of 1:3 to 20:1 wt. %.

15. Solid propellant according to claim 1, wherein the pure ammonium nitrate has a water content below 0.2 wt. %.

16. Solid propellant according to claim 1, wherein use is made of ammonium nitrate, which is phase-stabilized by reacting with 1 to 7 wt. % nickel oxide or 3 to 15 wt. % potassium or cesium nitrate.

17. Solid propellant according to claim 16, wherein the phase-stabilized ammonium nitrate (PSAN) is obtainable by mixing the additives into the melt of the pure ammonium nitrate (AN) and spraying the melt, accompanied by simultaneous cooling.

18. Solid propellant according to claim 15, wherein to the ammonium nitrate are added 0.1 to 1 wt. % of its fraction of ultrafine silica gel (particle size approx. 0.02 μm), sodium lauryl sulphonate, tricalcium phosphate or other surfactants as anticaking agents.

19. Solid propellant according to claim 1, wherein the ammonium nitrate is present with an average particle size of 10 to 80 μm.

20. Solid propellant according to claim 1, wherein the vanadium oxide/molybdenum oxide burning moderators are used in conjunction with Cu and Ni salts, oxides or complexes.

21. Solid propellant according to the claim 1, wherein the burning moderators contain mixed oxides of molybdenum of oxidation stages +VI and vanadium of oxidation stages +V and +IV.

22. Solid propellant according to claim 1, wherein the burning moderators have as the carrier material chromium (III) or titanium (IV) oxides.

23. Solid propellant according to claim 1, characterized in that the burning moderators have a particle size of 1 to 60 μm, preferably 1 to 10 μm and a large inner surface of 5 to 100 $m^2$ /g, preferably 20 to 60 $m^2$/g.

24. Solid propellant according to claim 1, characterized in that the latter contains when used in rocket engines 0.1 to 1 wt. % of high-melting metal carbides or nitrides as additives for suppressing an unstable, oscillating burning behaviour.

25. Solid propellant according to claim 22, characterized in that the additives are silicon and/or zirconium carbide.

* * * * *